US005375426A

United States Patent [19]

Burgener

[11] Patent Number: 5,375,426

[45] Date of Patent: Dec. 27, 1994

[54] PROCESS TO CLEAN A LUBRICATED VAPOR COMPRESSION REFRIGERATION SYSTEM BY USING CARBON DIOXIDE

[75] Inventor: David Burgener, Elmhurst, Ill.

[73] Assignee: Air Liquide America Corporation, Walnut Creek, Calif.

[21] Appl. No.: 175,552

[22] Filed: Dec. 30, 1993

[51] Int. Cl.[5] ..... F25B 47/00

[52] U.S. Cl. ..... 62/85; 62/292; 62/303

[58] Field of Search ..... 62/77, 85, 195, 149, 62/292, 303, 475

[56] References Cited

U.S. PATENT DOCUMENTS 4,934,390 6/1990 Sapp ..... 62/303
5,036,675 8/1991 Anderson, Jr. ..... 62/292

OTHER PUBLICATIONS

Publication "Retrofit Guidelines for SUVA® 134a (SUVA Cold MP) in Stationary Equipment", Illinois Supply Company, Wilmington, Del. 19898.

Publication entitled "Refrigerant Changeover Guidelines CFC-12 to HFC-134a", Copeland Corporation, Sidney, Ohio 45365.

*Primary Examiner*—John M. Sollecito
*Attorney, Agent, or Firm*—Burns, Doane, Swecker & Mathis

[57] ABSTRACT

A process for removing lubricant, hydrocarbons and mixtures thereof from a vapor compression mechanical refrigeration system by using carbon dioxide as a solvent is disclosed. The process is carried out using supercritical, liquified or gaseous carbon dioxide and removes lubricant to a level below about 5% so as to be compatible with environmentally acceptable refrigerants.

19 Claims, 1 Drawing Sheet

PROCESS TO CLEAN A LUBRICATED VAPOR COMPRESSION REFRIGERATION SYSTEM BY USING CARBON DIOXIDE

BACKGROUND OF THE INVENTION

1.Field of the Invention

The present invention relates to a process for cleaning a lubricated mechanical refrigeration system. In particular, the present invention relates to a process for removing lubricant, hydrocarbons and mixtures thereof from a lubricated vapor compression mechanical refrigeration system by using $CO_2$ as a solvent.

2. Description of Related Art

Recent legislation calls for the steady decrease in production of chlorofluorocarbons (CFCs) and hydrochlorofluorocarbons (HCFCs) refrigerants. By 1996, there is projected to be no more production of CFCs, and by approximately 2010, there is projected to be no more production of HCFCs. The future production of these chemicals is being banned because they escape into the upper atmosphere and cause the decomposition of the protective ozone layer. As production of CFC and HCFC refrigerants is reduced and ultimately phased out, environmentally acceptable replacement compounds are needed for use in existing refrigeration systems.

The mechanical refrigeration industry has a very large number of units that are presently operating on CFC and HCFC refrigerants. The vast majority of these units use mineral oil lubricated motor driven compressors. These compressors are typically available in hermetic, semi-hermetic, and belt-drive configurations. The mineral oil is miscible (or dissolves) in the CFC and HCFC refrigerants, and is essentially similar to motor oil, except that the mineral oil is highly refined and specially dried for refrigeration service. It is preferred that refrigerants are substantially free of water for proper functioning in a mechanical refrigeration system.

The lubricants used in mechanical refrigeration systems cover a wide range of compositions. Those oils and lubricants that are commonly used in existing CFC and HCFC refrigeration systems include naphthenic, paraffinic, and alkyl benzene lubricants. The newer hydrofluorocarbon (HFC) type refrigerants require the use of polyalkyleneglycols (PAG) and synthetic esters which are commonly called polyolesters (POE). Also applicable for use with the HFC refrigerants are other lubricants such as silicones and polytetrafluoroethylene blends which are manufactured from other synthetic compounds.

In the normal operation of a mechanical refrigeration system, a small amount of the compressor lubricating oil travels with the refrigerant, through the evaporator coil, and eventually returns to the compressor. Miscibility, material compatibility and flowability of the oil/refrigerant mixture are important to guarantee that the oil does, in fact, return back to the compressor rather than stay in the evaporator, which would result in reduced refrigeration capacity.

The refrigeration industry has developed HFCs as one of the potential replacements for the CFC and HCFC refrigerants. HFC refrigerants offer improved environmental properties such as a zero ozone depletion potential and a significantly lower global warming potential, as compared with CFC and HCFC refrigerants. The new HFC refrigerants are designed to operate in pressure and temperature ranges similar to that of most of the existing CFC and HCFC refrigerants.

The HFC refrigerants differ from CFC and HCFC refrigerants in that the former require the use of synthetic lubricating oils. These synthetic oils are typically either the POE type or PAG type. The standard naphthenic and paraffinic mineral oil lubricants used with CFC and HCFC refrigerants are not miscible with the HFC refrigerants and such a mixture would cause oil return problems. Therefore, in the case of conversion to HFC refrigerants, the mineral oil must be replaced with a compatible lubricant to allow proper operation of the mechanical refrigeration system. Replacing the lubricant in a mechanical refrigeration system is a difficult and complicated process.

There are also refrigerant blends available that are primarily mixes of existing HCFCs and HFCs that will be manufactured for twenty to thirty more years. These have similar operating characteristics to the ozone depleting CFCs, but will eventually be phased out as the HCFCs are eliminated. The blends are typically semi-azeotropic, which means that they will tend to separate into their various components in the event that there is a slow leak. These refrigerants typically require the use of alkylbenzene lubricant, and can withstand a higher percentage of residual mineral oil to maintain proper operation. However, in systems with high percentages of lubricating oil external to the compressor, it still may be necessary to flush the original lubricant from the system.

The refrigeration industry is faced with the task of either replacing entire units with HFC designed and compatible systems, or converting existing ones to HFC refrigerants, which require synthetic lubricants. The mineral oil concentration in HFC systems is preferably reduced to below about 5% of the total oil concentration to prevent the residual mineral oils from accumulating in the evaporator, a problem commonly called "logging". Due to the poor miscibility of mineral oil in HFC refrigerants, a mixture of synthetic oil and mineral oil could cause disruption of the system operation. Allowable residual mineral oil levels are highly dependent upon system configuration and operating conditions. When the system shows signs of poor evaporator heat transfer or poor oil return to the compressor, it may be an indication that a further reduction in the residual mineral oil level is required. Thus, the refrigeration art seeks a suitable method to effectively switch CFC/HCFC to HFC refrigerants in such systems.

The manufacturer's standard recommended procedure for eliminating mineral oil from a refrigeration system being converted to HFC refrigerants is to use multiple oil changes. Typically, the CFC refrigerant is removed from the system and collected. The mineral oil is drained from the system and replaced with an equal amount of synthetic oil having a viscosity similar to that of the mineral oil. The original CFC refrigerant is reintroduced into the system, which is allowed to run for a number of days to mix and dilute the synthetic and mineral oil mixture. The contaminated synthetic oil is drained from the system and replaced with a fresh quantity of synthetic oil. This process is repeated one or more times, as necessary. Typically, the system is drained at least three times. After the final flush the CFC refrigerant is replaced with HFC refrigerant. The goal is to remove the original lubricant by the process of dilution with synthetic oil to a concentration of approximately 5% or less.

This procedure is capable of eventually removing the original lubricant, but requires multiple service calls on the part of the service technician, and is costly. In addition, the synthetic oils are quite expensive, and the large volume of contaminated synthetic oil generated by this process must be properly disposed of.

Another cleaning method includes the use of compressed gases to remove obstructions. Typically, this process includes applying pressure to one end of the system to blow out blockages in the system. The pressure builds up on the intake side of the obstruction until the obstruction breaks loose and is carried out of the system due to the velocity of the released gas pressure. For example, gaseous carbon dioxide and nitrogen have been used in the past by refrigeration technicians for removing obstructions, blowing out foreign materials and leak testing systems. These uses were limited to gaseous applications only, with the compressed gases used as nothing more than a pressurized media to mechanically clear tubing or detect leaks.

Another solution for eliminating conventional oils from a system being converted to HFC refrigerants is to use R-11 (tetrafluoromethane) or 1,1,1 trichlorethylene and other aggressive solvents. The R-11 is a CFC and has the highest ozone depletion potential, so its use is no longer a viable solution. Other solvents such as 1,1,1 trichlorethylene are ozone depleters, toxic, and present disposal problems. The cost of disposing of these contaminated solvents is considerable.

Thus, the preferred procedure presently known in the art for cleaning such systems is the multiple oil change procedure noted above. Consequently, the refrigeration art lacks an economical, quick, efficient and environmentally sound way to switch from CFC/HCFC refrigerants to HFC refrigerants in oil lubricated vapor compression refrigeration systems.

The art also lacks a simple method to remove lubricating oils and other contaminating hydrocarbons from refrigeration systems. A hermetic or semi-hermetic refrigeration compressor is designed so that the entire motor compressor assembly is inside a sealed pressure container to prevent refrigerant loss through shaft seals. The typical failure of such a system is a motor burnout. Since the motor is surrounded by lubricating oil and refrigerant, the resulting heat and electrical arc causes these components to breakdown into acids, ash and other hydrocarbons. These undesirable products are typically circulated throughout the entire system prior to failure.

A primary problem with motor burnouts is the inability to adequately clean the refrigeration system of all of the internally decomposed products. If not sufficiently cleaned out, residual acids, decomposed motor varnish, and contaminated refrigerant will dramatically reduce the life of a replacement compressor. Present methods in the art for solving these problems include flushing the system with clean refrigerant, multiple changes of the filter/dryer, as well as, adding additional strainers. Frequent replacement of filters and strainers is required to gradually purify the repaired system. Moreover, flushing with refrigerant is now difficult, if not impossible, due to laws preventing atmospheric discharge of refrigerants. Flushing systems with clean refrigerant contaminates the refrigerant with decomposed products making the contaminated refrigerant expensive to dispose of and not recyclable. In many cases, replacement compressors have failed prematurely due to inadequate removal of the contaminants from the remainder of the system after a burnout. Thus, the art is searching for methods to remove not only lubricating oils but other decomposed hydrocarbons from such refrigeration systems.

SUMMARY OF THE INVENTION

In accordance with one aspect of the present invention, there is provided a process for removing lubricants thereof from a lubricated vapor compression refrigeration system by washing the system with a carbon dioxide solvent.

In accordance with another aspect of the present invention, there is provided a process for removing hydrocarbon contaminants from a lubricated vapor compression refrigeration system by washing with a carbon dioxide solvent.

In accordance with a further aspect of the present invention, there is provided a process for removing oil from an oil lubricated vapor compression refrigeration system by washing the system with a liquid carbon dioxide solvent.

In accordance with a further aspect of the present invention, there is provided a process which uses gaseous carbon dioxide as a solvent to remove lubricating oils to a concentration below about 5%.

In accordance with a further aspect of the present invention, there is provided a process for removing oil and other contaminating hydrocarbons from an oil lubricated vapor compression refrigeration system having a hermetic or semi-hermetic compressor by washing the system with a liquid carbon dioxide solvent.

In accordance with a further aspect of the present invention, there is provided a process for removing oil from an oil lubricated vapor compression refrigeration system by washing the system with a carbon dioxide solvent, wherein the system is at cold storage or ambient temperatures.

BRIEF DESCRIPTION OF THE DRAWING

Other objects, features and advantages of the present invention will become apparent from the following detailed description and accompanying drawing wherein.

DETAILED DESCRIPTION OF PREFERRED EMBODIMENTS

Figure 1:
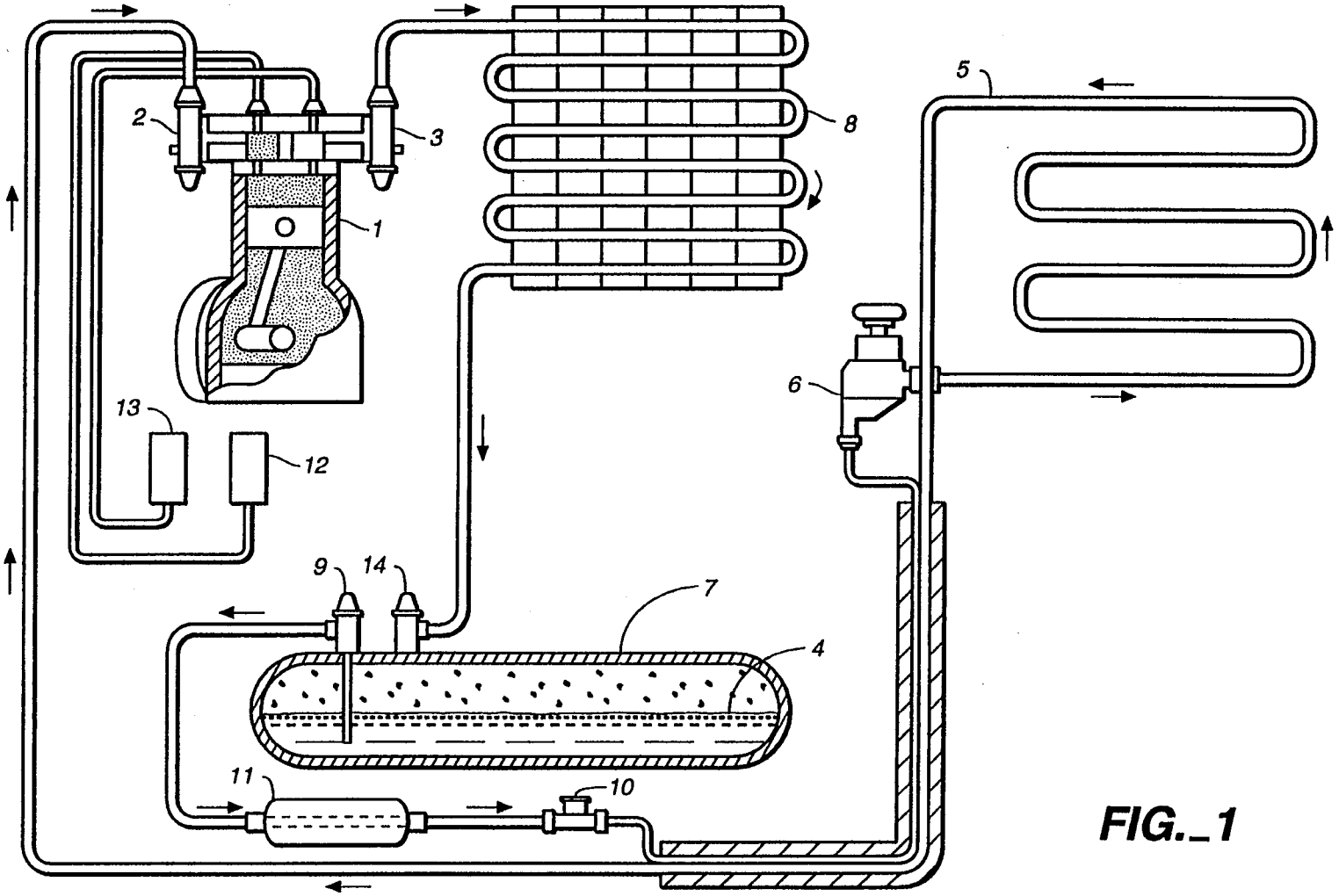
FIG. 1 is a schematic flow diagram of a lubricated vapor compression refrigeration system.

The present invention is a process for cleaning a lubricated vapor compression refrigeration system by using carbon dioxide as a solvent. The process of the present invention is useful for removing lubricant, hydrocarbons and mixtures thereof from a mechanical refrigeration system. The process of the present invention is useful for removing a variety of different types of lubricants which include those oils and lubricants that are commonly used in existing CFC and HCFC refrigeration systems, for example, naphthenic, paraffinic, and alkyl benzene lubricants and those oils and lubricants that are commonly used in the newer HFC type refrigerants, for example, PAG, POE and other lubricants such as silicones and polytetrafluoroethylene blends which are manufactured from other synthetic compounds.

The process includes using carbon dioxide as a solvent to wash lubricant, hydrocarbons and other impurities from the refrigeration system. The process of the present invention includes the following: recover the original refrigerant from the system; drain the lubricant; flush the refrigeration system with carbon dioxide solvent; recover the lubricant contaminated carbon dioxide, and charge the system with replacement refrigerant and compatible replacement lubricant.

The process of the present invention is useful for effectively switching from CFC/HCFC refrigerants to HFC refrigerants in such refrigeration systems. These types of refrigerants should not be mixed. Refrigerant mixes create an azeotrope that can cause extremely high discharge pressures that could damage equipment. The present invention is not limited to the use of any particular type of refrigerant, but may be used with any lubricated refrigeration system. More particularly, the process of the present invention is useful for removing mineral oil lubricant used with CFC and HCFC refrigerants and replacing them with synthetic oil lubricant and HFC refrigerant. Conversely, the process of the present invention is useful for removing synthetic oil lubricant used with HFC refrigerants and replacing them with mineral oil lubricant and CFC and HCFC refrigerants. For example, the process of the present invention can reduce lubricant levels in the refrigeration system to below about 5% with a single washing, thus preventing these original oils from accumulating in the evaporator of a converted system. The effectiveness of the process of the present invention may be reduced in ammonia based ($NH_4$) systems where the introduction of carbon dioxide would form ammonium carbonate, a solid material, that could become trapped in internal system piping.

Carbon dioxide is cheap, readily available, and environmentally friendly. Carbon dioxide is an excellent solvent and is one of the best natural solvents available. Supercritical, liquid or gaseous carbon dioxide are suitable for use in the process of the present invention.

Liquid carbon dioxide is the preferred solvent media because of the large amount of lubricant that can be dissolved in it. Additionally, liquid carbon dioxide has pressure and temperature characteristics that are compatible with typical refrigeration systems. Liquid carbon dioxide has better solvent properties than gaseous carbon dioxide. Liquid carbon dioxide can be used to clean cold refrigeration systems preferably at a temperature of from about (+)30° F. at an equilibrium pressure of about 500 pounds per square inch gauge (psig) to about (−)70° F. at an equilibrium pressure of about 60 psig. Liquid carbon dioxide is available only under elevated pressure from about 60 psig to about 1056 psig and reduced temperature.

Gaseous carbon dioxide can be used as a solvent in the process of the present invention by maintaining the entire system under a uniform elevated pressure which enables the gas flow to act as a solvent to remove the lubricant. A pressure maintenance device is installed at the exit of the system to maintain the desired uniform elevated pressure during this procedure. The elevated pressure reduces the viscosity and increases the solubility of the oil. This effect is not achievable by simply forcing compressed gases through the system similar to the process used to remove obstructions.

Supercritical carbon dioxide is suitable for use in the process of the present invention since it has even greater solvent properties than liquid or gaseous carbon dioxide. Supercritical carbon dioxide exists at elevated temperature and pressure, and typically must be above about 1,056 psig and about (+)88° F. This high pressure is usually beyond the design working pressure of most mechanical refrigeration systems. However, supercritical carbon dioxide can be used in accordance with the present invention to remove lubricants from refrigeration systems that are compatible with such elevated conditions.

The present mechanical refrigeration system art uses a number of different types of vapor compression devices. These types include reciprocating piston compressors, rotating screw type, centrifugal, and scroll type compressors. These compressors are typically available in either belt driven, hermetic or semi-hermetic style construction. The present invention is applicable to all of these style systems since they all have sliding, rotating or moving parts that are lubricated by a circulated refrigerant and lubricant mixture. The components in most standard mechanical refrigeration systems typically have a maximum working pressure of about 500 psig. Therefore, the method of the present invention used for cleaning this type of system can be maintained at a pressure below about 500 psig to maintain a safe operating condition. Furthermore, most systems are fabricated from copper, brass, steel and common gasket materials which are fully compatible with carbon dioxide.

Liquid carbon dioxide is commercially available primarily in two forms: high pressure liquid cylinders and low pressure bulk liquid. The primary difference between the two forms of carbon dioxide is the temperature at which the liquid carbon dioxide is stored. A pressure regulating device is required to reduce the pressure of the liquid carbon dioxide high pressure cylinders below the maximum working pressure of the refrigeration system. The process of decreasing the pressure as the liquid exits the cylinder causes a portion of the liquid to flash to a gaseous form which produces a two-phase flow. The gaseous carbon dioxide can be removed from the two-phase stream, but this is not necessary since the liquid carbon dioxide portion has adequate solvent properties to remove lubricant that is present in the refrigeration system.

The pressure inside the high pressure liquid cylinder changes with ambient temperature, and typically varies from about 200 psig at about (−)20° F. to in excess of about 1,000 psig at about (+)100° F. Bulk liquid carbon dioxide is available only in refrigerated form and is typically maintained at between about 200 psig and about 300 psig. In both commercially available forms, carbon dioxide is used in the method of the present invention both as a solvent and a pressurizing agent to extract lubricant and other residues. The process of the present invention can clean the system without leaving a residue and is compatible with most standard materials and the pressure ratings of refrigeration systems.

Nitrogen or other gases can be used in combination with carbon dioxide to mechanically force oil and residues out of the system, but these gases do not have the solvent capabilities of carbon dioxide. Other gases could be used in combination with carbon dioxide for cleaning the system, but these gases would be used primarily as a pressure media to remove the oil by the gas velocity passing through the tubing. Thus, the use of these other gases alone would make adequate cleaning of the refrigeration system difficult. In contrast, gaseous carbon dioxide acts as both a solvent and a pressure media to remove oil from the refrigeration system.

The following include examples of the advantages of the process of the present invention using carbon dioxide as a medium for cleaning lubricant from a mechanical refrigeration system.

Carbon dioxide reduces the viscosity of oils causing them to flow freer. This viscosity reduction is especially important when cleaning refrigeration systems because a thin film of lubricating oil coats the surface of most of the parts. Reducing the surface tension and viscosity of the lubricating oil makes the oil flow better, and therefore easier to remove than oil having a higher surface tension and viscosity.

The process of the present invention is especially useful for cleaning the refrigeration systems of bulk carbon dioxide storage tanks without removing the contents. Bulk carbon dioxide storage tanks are typically maintained at operating temperatures of from about (−)20° F. to about (+)13° F. The evaporator coil for the refrigeration system is mounted inside the storage tank. When such refrigeration systems are in the process of being converted to HFC refrigerants, the evaporator coil is cold, thereby making any refrigeration oil lubricant even thicker and harder to remove than oil at a warmer temperature. The same would be true on non-carbon dioxide systems which need to remain cold prior to and during the refrigerant conversion process. The viscosity reducing properties of carbon dioxide enable the thickened cold oil to be removed more easily than other solvents.

The process of the present invention includes flowing carbon dioxide liquid through the system at a pressure of from about 60 psig to about 500 psig. The refrigeration system is maintained at a constant pressure throughout to keep previously dissolved oils from dropping out of solution. There is a throttling device placed on the outlet of the system to expand the liquid carbon dioxide to atmospheric pressure. The liquid carbon dioxide converts to a mixture of solid (dry ice) and cold gas at (−)109° F. Liquid carbon dioxide is passed through the refrigeration system at a constant pressure and exits through the throttling device, thereby dissolving the lubricating oils and contaminants within the system. This procedure enables the collection of the lubricant without providing an atomized mist of oil droplets which would be difficult to contain and would present a pollution problem.

Carbon dioxide is naturally occurring and non-polluting. Release of carbon dioxide to the atmosphere is not detrimental due to the fact that normal atmospheric levels are 300 parts per million.

Commercial bulk carbon dioxide is available at pressures of from about 200 psig to about 300 psig. Standard refrigeration systems typically have working pressures of less than about 500 psig. Therefore, bulk liquid carbon dioxide is available at pressures and temperatures that are compatible with the components in a standard mechanical refrigeration system.

High pressure commercial carbon dioxide cylinders are available at pressures ranging from about 200 psig to greater than about 1,000 psig depending upon ambient temperature. Since standard refrigeration systems typically have working pressures of less than 500 psig, the high pressure liquid carbon dioxide of the present invention is used at a pressure regulated to below about 500 psig to be compatible with components in such standard mechanical refrigeration systems.

Carbon dioxide gas and liquid are substantially inert and compatible with most metals and plastics. However, there is a tendency of carbon dioxide to cause swelling in some rubber elastomers such as butadiene-acrylonitrile. For this reason, liquid carbon dioxide may not be recommended for use with a compressor which contains certain rubber elastomers which are not inert to carbon dioxide. Typically, the compressor is manufactured from materials such as cast iron, which have limited ductility at liquid carbon dioxide temperatures. Therefore, the compressor is only optionally flushed depending upon material temperature and pressure suitability.

The process of the present invention is useful for washing the evaporator and components external to the compressor where residual lubricant accumulates. The system is maintained at a pressure of from about 60 psig to about 500 psig so that the majority of the carbon dioxide remains in the liquid form. The liquid carbon dioxide is passed through a pressure reducing device such as an orifice, needle valve, or throttling device, and the like, which decreases the liquid to atmospheric pressure.

Liquid carbon dioxide has the unique property of converting directly to the solid dry ice phase and cold gas at (−)109° F. when reduced to atmospheric pressure. This property traps the lubricant and other particulate matter in the solid dry ice phase, while allowing the flash vapor to escape to the atmosphere without carrying lubricant. The liquid carbon dioxide solvent is typically at a temperature of between about (+)30° F. and about (−)69° F. These temperatures are relatively easy to maintain in ambient conditions without excessive boiling of the liquid carbon dioxide. The lubricant that exits with the dry ice snow is cooled to (−)109° F. This extremely low temperature increases the lubricant viscosity to a syrup or paste-like consistency so that it does not exit with the flash gas, but rather is retained with the dry ice. Simply allowing the accumulated dry ice to sublime (convert from the solid to the gas phase from atmospheric heat input) causes the carbon dioxide gas to harmlessly escape to the atmosphere and leave the residual lubricant behind. Dry ice snow could also be used to wash the system, but the (−)109° F. temperature would cause the lubricant to solidify and not flow as well as lubricant at a higher temperature. Accordingly, the process of the present invention provides the ability to recover lubricant from a refrigeration system without the need for expensive exotic lubricant recovery techniques.

For example, when a typical 5 horsepower system is flushed with liquid carbon dioxide it takes a few minutes for liquid carbon dioxide to initially reach the snow horn and start producing snow. If the evaporator coil is heavily filled with oil, the first volumes of snow will look more like oily toothpaste. Preferably, the first volume of snow is collected in a clean 5 gallon container as it contains the majority of the system oil lubricant. The process can be used to continue making snow in a larger 24 to 32 gallon container until the container is full (about 100 lbs) or the system is clean.

Typically, a 5 horsepower system has about 300 to 500 ml of oil in the evaporator (½ cup). Other systems have had as much as 1½quarts recovered. If more than one cup of oil is removed from the evaporator, it is necessary to closely monitor the compressor oil level. Large accumulations of oil in the evaporator reduce refrigeration efficiency and may cause the compressor to fail due to lack of lubricating oil.

Failure to remove all the residual mineral oil can cause compressor failure and will cause mineral oil to accumulate in the evaporator. The mineral oil lubricant may accumulate in the evaporator causing system capacity loss. Mineral oils are not miscible (do not dissolve) in HFC refrigerants and can cause a sludge-like buildup.

Most of the lubricant that is outside of the compressor in the refrigeration system will be found in the evaporator coil. Very little will be in the condenser because during operation the condenser is typically warm and the warm lubricant is more soluble in the liquid refrigerant. Tests have shown that residual lubricant concentration in the condenser is at very low levels and the condenser may not require cleaning.

Liquid carbon dioxide is an excellent solvent and removes substantially all the residual oils from the system. The retrofit procedure of the present invention decreases the residual mineral oil level in the system to below about 5%, and preferably below about 3% of the total oil. This result is achieved by a single procedure without having to do multiple oil changes.

There are millions of mechanical refrigeration systems that are in service around the U.S. and the world. These operate primarily on CFC and HCFC refrigerants using mineral oil lubricants. The compressors operating in these systems range in capacity from fractional horsepower to hundreds of horsepower for large commercial systems. The process of the present invention is useful for removing lubricant from all of these types of systems.

The present invention enables the carbon dioxide industry to use this technology for cleaning and servicing the refrigeration systems on bulk carbon dioxide storage tanks. By the present invention, the industry is provided with an alternative to the use of conventional multiple oil change conversion methods to flush the old lubricant out of the system. This prior art flushing method would require at least two additional service calls to the storage tank and probably take about three to four additional days to complete than the process of the present invention.

The method of the present invention also enables refrigeration service organizations to convert standard commercial and residential refrigeration systems to HFC refrigerants using the present carbon dioxide cleaning technique.

The process of the present invention is useful for cleaning a refrigeration system having a hermetic or semi-hermetic compressor that has sustained a motor burnout by removing lubricant and hydrocarbon contaminants caused by the compressor burnout. The procedure is used to remove contaminants whether the original refrigerant is replaced or converted to HFC refrigerants. Hermetic refrigeration systems are designed with the motor sealed inside the system to eliminate the need for shaft seals. One of the common failures in this type of system is a burnout of the motor. This burnout causes items such as motor varnish, lubricating oils, refrigerant and elastomers to decompose into acids and other hydrocarbon contaminants, which are spread throughout the entire system. The solvent properties of carbon dioxide are used to not only remove the lubricating oil, but the other contaminating hydrocarbons as well.

The following procedure is an example of the process of the present invention for removing a sufficient amount of lubricant from a mechanical refrigeration system. The process is also equally useful on refrigeration systems which must be kept cold during the cleaning as well as those which are not in use during the cleaning.

A suitable retrofit process for removing a sufficient amount of mineral oil from a CFC mechanical refrigeration system includes the following:

Recover the CFC refrigerant from the system;
drain the mineral oil from the system;
flush the refrigeration system with carbon dioxide solvent;
recover the flushed solid carbon dioxide and mineral oil;
remove the mineral oil from the compressor and replace with synthetic oil, such as polyolester oil;
replace the filter dryer with an HFC compatible one;
evacuate the system and check for leaks;
charge the system with HFC refrigerant; and
start the system and adjust the controls.

As an example, the above procedure would require between about 8 and 16 hours to complete, depending upon the system condition and the familiarity of the technician with the system. The process of the present invention uses carbon dioxide, which is a material that is easily handled by refrigeration service technicians. It is assumed the technician is knowledgeable about liquid carbon dioxide and its properties.

Referring to FIG. 1, there is shown the basic features of a refrigeration flow schematic wherein the refrigeration system contains a compressor 1, having a suction valve 2 and a discharge valve 3; refrigerant 4; an evaporator coil 5; an expansion device 6, which is located between the evaporator coil 5 and a refrigerant receiver 7; and a condenser 8. Liquid refrigerant 4 exits the receiver 7 through a receiver outlet valve 9 and passes through a sight glass 10 and filter/dryer 11. The liquid refrigerant 4 is evaporated to a gas in the evaporator coil 5 after it passes through the expansion device 6. The gaseous refrigerant exits the evaporator coil 5 and enters the compressor 1 through the suction valve 2 and exits to the condenser 8 through the discharge valve 3. The compressor 1 is regulated by a low pressure switch 12' and a high pressure switch 13. The high pressure refrigerant 4 is condensed to a liquid in the condenser 8 where it enters the receiver 7 through a receiver inlet valve 14. The arrows indicate the direction of refrigerant flow.

EXAMPLE 1

REMOVING LUBRICATING OIL FROM A REFRIGERATION SYSTEM BY USING BULK LIQUID CARBON DIOXIDE AS A SOLVENT

The following is a procedure to convert the refrigeration system of a carbon dioxide storage tank from R-12 refrigerant (CFC) to HFC 134a. The basic features of this refrigeration system are represented in the flow schematic diagram of FIG. 1. This retrofit permits the refrigeration system to operate normally using HFC R-134a with no atmospheric ozone depleting potential. There is an approximate 10 to 15% loss in cooling capacity due to the lower density of the suction vapors on the R-134a refrigerant. Belt driven compressors can be speeded up by 15% to compensate for this, but hermetic and semi-hermetic compressors operate with a capacity loss.

This procedure can also be used to convert a variety of different types of carbon dioxide storage tanks.

The following procedure describes conversion of the refrigeration system of a 13 ton fiberglass insulated carbon dioxide storage unit referring to FIG. 1. Other units can be retrofitted in the same manner but the fitting sizes and component location may vary slightly.

1. Determine baseline operating data for the CFC-12 system.
2. Close the receiver outlet valve 9 on the refrigerant receiver 7.
3. Bypass the carbon dioxide tank pressure switch to cause the pumpdown solenoid valve to open. This causes the compressor 1 to start forcing all but a small amount of refrigerant 4 into the receiver 7.
4. Close the liquid receiver inlet valve 14. The majority of the CFC-12 charge in the receiver 7 is liquid and now isolated from the rest of the system.
5. Connect a refrigerant recovery unit to the compressor suction valve 2 and discharge valve 3 and recover any remaining CFC-12 vapor.
6. Remove the line from the condenser 8 to the liquid receiver inlet valve 14.
7. Remove the line from the liquid receiver outlet valve 9 to the filter/dryer 11.
8. Connect the refrigerant recovery unit to the liquid receiver outlet valve 9 and recover the remaining liquid refrigerant.
9. Weigh the recovery cylinder to determine the CFC-12 recovered. A full charge is typically 20 to 22 lbs.
10. Unbolt the expansion device 6 power assembly. Remove the internal cage and insert an O-ring or sealing gasket into the bore of the power assembly and retighten. This allows free flow of liquid carbon dioxide during the flushing process.
11. Install a blind flange plate between the suction valve 2 and compressor 1 and retighten the bolts. This prevents liquid carbon dioxide from entering the compressor 1.
12. Connect the hose from a liquid storage unit (optionally an alternate 60 to 500 psig liquid carbon dioxide supply can be used) to the compressor suction valve 2.
13. Connect a hose and a snow horn to the filter/dryer 11. Place the snow horn into a plastic garbage can or similar sized collection container.
14. Flush the evaporator coil 5 with liquid carbon dioxide. Open the liquid carbon dioxide fill valve on the storage unit. The dry ice "snow" that discharges from the snow horn contains a mixture of oil and dry ice. Discharge the snow into a 24 to 30 gallon container, and allow the dry ice to sublime. Collect and measure the residual oil for proper disposal.
15. Close the liquid carbon dioxide supply valve and allow the system to depressurize.
16. Connect the liquid carbon dioxide supply hose to the refrigerant receiver inlet valve 14.
17. Connect the snow horn and hose to the refrigerant receiver outlet valve 9.
18. Flush the refrigerant receiver 7 with liquid carbon dioxide. Collect at least 5 to 10 lbs of dry ice and recover the residual oil (50 to 100 ml). Close the liquid carbon dioxide valve and depressurize the system as in Step #15.
19. Replace the original filter/dryer 11 with a type compatible with HFC-134a.
20. Remove the blind flange plate on the compressor.
21. Unbolt the expansion device 6 power assembly. Remove the O-ring and insert a new cage assembly. Reassemble the expansion device 6.
22. Drain the mineral oil from the compressor 1 (optionally, the compressor can be replaced if required).
23. Measure and record the oil volume removed. Compare with that recommended by the manufacturer.
24. Re-install the drain plug and add i quart of ester oil. Rotate the compressor 1 a few revolutions to mix with the residual oil and drain. This washes residual oil from the compressor crankcase by dilution.
25. Repeat Step #24. All oils should be properly disposed of as waste oil.
26. Fill the compressor 1 with ester oil to the level required by the compressor manufacturer. The resulting lubricant had below 3% mineral oil concentration.
27. Attach a tag to the compressor 1 indicating the unit uses HFC-134a and ester oil.
28. Evacuate the system to remove air and moisture. Leak test the system using normal service practices.
29. Charge the system with HFC-134a. The correct charge is 90 to 95% of the original CFC-12.
30. Start up the system and let the expansion device 6 stabilize. The thermostatic expansion device may need to be readjusted.
31. Adjust the high 13 and low pressure 12 switches as required.

EXAMPLE 2

REMOVING LUBRICATING OIL FROM A REFRIGERATION SYSTEM BY USING HIGH PRESSURE CYLINDER CARBON DIOXIDE AS A SOLVENT

The same procedure as described in Example 1 would be used, except that the carbon dioxide supply would be a standard high pressure liquid carbon dioxide cylinder having a syphon tube. The cylinder would be equipped with a pressure reducing device, such as a liquid pressure regulator, set at about 500 psig or less. The liquid carbon dioxide exiting the cylinder would be at ambient temperature and after passing through the regulator the pressure would be reduced and the liquid would achieve a thermodynamic balance of liquid and cold gas at a lower pressure. The carbon dioxide would then be used to wash the refrigeration system as described in Example 1 starting with Step #12. All other steps would be followed, accordingly.

EXAMPLE 3

REMOVING LUBRICATING OIL AND HYDROCARBON CONTAMINANTS CAUSED BY A HERMETIC OR SEMI-HERMETIC COMPRESSOR BURNOUT BY USING BULK LIQUID CARBON DIOXIDE AS A SOLVENT

The following is a procedure that would be used to clean a 5 horsepower refrigeration system having a hermetic or semi-hermetic compressor that has sustained a motor burnout. The procedure would remove contaminants whether the original refrigerant is replaced or converted to HFC refrigerants.

The procedure, referring to FIG. 1, includes the following steps:

1. Connect a refrigerant recovery unit to the suction valve 2 and discharge valve 3 on the compressor 1 and remove the contaminated refrigerant 4. This refrigerant cannot be recycled due to the high level of foreign materials and must be properly disposed of.
2. Weigh the recovery cylinder to determine the amount of refrigerant removed from the system.
3. Disassemble the expansion device 6. Remove the internal cage assembly, and insert an O-ring or sealing gasket into the space and reassemble.
4. Remove the defective compressor 1.
5. Install a blind flange plate on both the suction valve 2 and discharge valve 3 connections. This will seal the system and allow liquid carbon dioxide pressure to be maintained in the refrigeration system. Follow Steps #12 through #15 of Example 1 to flush oil and contaminants from the evaporator coil 5 and piping up to the compressor suction valve 2.
6. Connect the liquid carbon dioxide supply hose to the compressor discharge valve 3.
7. Connect a snow horn and hose to the receiver outlet valve 9 of the liquid receiver 7.
8. Flush the liquid receiver 7 with liquid carbon dioxide, collect at least 100 pounds of dry ice, and recover the residual oil, typically 50 to 100 ml. Close the liquid carbon dioxide valve and depressurize the system as in Step #14 of Example 1. This procedure is slightly different than that in Example 1 because the condenser and connecting piping are contaminated with hydrocarbons that also need to be cleaned.
9. Collect a small quantity (3 to 5 lbs) of the dry ice snow and residue from the carbon dioxide flushing process just prior to stopping. Sublime this dry ice and check for visual or chemical evidences of residue. Commercially available acid test kits can be used to evaluate whether the system is clean enough to proceed. If too much residue is still present, the system may require further flushing with carbon dioxide.
10. Install an oversize filter/dryer 11 assembly or multiple filter/dryer 11 assemblies to trap residual contaminants.
11. Install a suction strainer (not shown) upstream from the suction valve 2 to trap contaminants prior to entering the compressor 1.
12. Install a replacement compressor 1.
13. Evacuate the system to remove air and residual moisture. Hold a 30" vacuum for one hour.
14. Leak test the system using normal system practices.
15. Charge the system with the manufacturer's recommended oil charge.
16. Charge the system with the appropriate refrigerant.
17. Turn on the system and check for proper operation and adjust switches and controls as required.

Other objects, features and advantages of the present invention will become apparent from the foregoing detailed description and accompanying examples. It should be understood, however, that the detailed description and specific examples, while indicating preferred embodiments of the invention, are given by way of illustration only, since various changes and modifications within the spirit and scope of the invention will become apparent to those skilled in the art from this detailed description.

What is claimed is:

1. A process for removing lubricant, hydrocarbons or mixtures thereof from a lubricated vapor compression refrigeration system comprising:
a) recovering a first refrigerant from said system;
b) draining a first lubricant from said system;
c) flushing said system with a solvent comprising carbon dioxide;
d) removing the flushed carbon dioxide and first lubricant from said system; and
e) charging said flushed system with a second refrigerant and a compatible second lubricant.

2. The process according to claim 1, wherein said solvent comprises supercritical carbon dioxide, liquid carbon dioxide, gaseous carbon dioxide, or mixture thereof.

3. The process according to claim 1, wherein said first lubricant comprises mineral oil and said second lubricant comprises synthetic oil.

4. The process according to claim 1, wherein said first lubricant comprises synthetic oil and second lubricant comprises mineral oil.

5. The process according to claim 1, wherein said first refrigerant comprises chlorofluorocarbon refrigerant, hydrochlorofluorocarbon refrigerant, a mixture of hydrochlorofluorocarbon and hydrofluorocarbon refrigerant, or hydrofluorocarbon refrigerant.

6. The process according to claim 1, wherein said second refrigerant comprises chlorofluorocarbon refrigerant, hydrochlorofluorocarbon refrigerant, a mixture of hydrochlorofluorocarbon and hydrofluorocarbon refrigerant, or hydrofluorocarbon refrigerant.

7. The process according to claim 1, wherein said charged system comprises less than about 5% by weight of said first lubricant based on the weight of the total lubricant.

8. The process according to claim 1, wherein said solvent comprises liquid carbon dioxide between about 60 psig and about 1056 psig.

9. The process according to claim 8, wherein said process further comprises recovering said first lubricant flushed by the liquid carbon dioxide solvent from said system by subliming the flushed solid carbon dioxide, which contains said flushed first lubricant, after the carbon dioxide gas created by sublimation escapes.

10. The process according to claim 8, further comprising recovering said first lubricant flushed by the liquid carbon dioxide solvent from said system by collecting the resulting solid carbon dioxide which contains said flushed first lubricant.

11. The process according to claim 1, wherein an evaporator coil of said system is at a cold operating temperature and said carbon dioxide solvent is a liquid at a temperature of from about −70° F. and about 60 psig to about +50° F. and about 500 psig.

12. The process according to claim 9, further comprising recovering said first lubricant as a liquid and preventing release of said first lubricant to the atmosphere as an aerosol.

13. The process according to claim 1, wherein said system comprises a semi-hermetic or hermetic compressor with a motor burnout and said flushed carbon dioxide further comprises hydrocarbon contaminants created by internal decomposition of refrigeration components.

14. The process according to claim 13, wherein said flushing comprises the use of liquid or gaseous carbon dioxide at a pressure less than about 500 psig to dissolve and remove decomposed materials and hydrocarbons caused by the motor burnout.

15. The process according to claim 13, wherein said removing comprises the use of solid carbon dioxide to collect and recover decomposed materials and hydrocarbons caused by the motor burnout.

16. A process for replacing mineral oil with synthetic oil in an oil lubricated vapor compression refrigeration system comprising:

a) recovering existing refrigerant from said system;

b) draining the mineral oil from said system;

c) flushing said system with a solvent comprising carbon dioxide;

d) removing the flushed carbon dioxide and mineral oil from said system; and e) charging said flushed system with a hydrofluorocarbon refrigerant and compatible synthetic oil.

17. The process according to claim 16, wherein said solvent comprises supercritical carbon dioxide, liquid carbon dioxide, gaseous carbon dioxide, or mixture thereof.

18. The process according to claim 16, wherein said charged system comprises less than about 5% by weight of said mineral oil based on the weight of said synthetic oil.

19. The process according to claim 16, wherein said existing refrigerant comprises chlorofluorocarbon, hydrochlorofluorocarbon, a mixture of hydrochlorofluorocarbon and hydrofluorocarbon, or a non-chlorofluorocarbon.

* * * * *